US007758322B2

(12) United States Patent
Chang et al.

(10) Patent No.: US 7,758,322 B2
(45) Date of Patent: Jul. 20, 2010

(54) FAN SYSTEM

(75) Inventors: Shun-Chen Chang, Taoyuan Hsien (TW); Wei-Chun Hsu, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1146 days.

(21) Appl. No.: 11/391,542

(22) Filed: Mar. 29, 2006

(65) Prior Publication Data

US 2006/0245948 A1 Nov. 2, 2006

(30) Foreign Application Priority Data

Apr. 28, 2005 (TW) ..... 94113695 A

(51) Int. Cl.
*F04B 17/02* (2006.01)

(52) U.S. Cl. ..... 417/408; 415/202; 416/146 R

(58) Field of Classification Search ..... 417/408, 417/406, 407; 415/202; 416/146 R, 203
See application file for complete search history.

(56) References Cited

U.S. PATENT DOCUMENTS

| | | | | |
|---|---|---|---|---|
| 3,904,324 | A * | 9/1975 | Flatt et al. | 417/355 |
| 5,427,508 | A * | 6/1995 | Kapich | 417/374 |
| 6,591,873 | B1 * | 7/2003 | McNeil | 141/4 |
| 6,652,225 | B2 * | 11/2003 | Esa | 415/159 |
| 6,899,523 | B2 * | 5/2005 | Wobben | 416/132 B |

* cited by examiner

*Primary Examiner*—Charles G Freay
(74) *Attorney, Agent, or Firm*—Birch, Stewart, Kolasch & Birch, LLP

(57) ABSTRACT

A fan system includes a first airflow generator providing a main airflow, a duct having a first feeding port to guide the main airflow, and a first fan. The first fan includes a base, a rotor connected to the base by a shaft, and a plurality of blades connected to the rotor. Each blade includes a passive part corresponding to the first feeding port and an active part. The main airflow drives the passive part rotating about the shaft to synchronously rotate the active part, dissipating heat from a heat source, increasing flow rate of airflow and decreasing pressure. The amount and location of the fans can be flexibly configured.

17 Claims, 5 Drawing Sheets

FAN SYSTEM

BACKGROUND

The invention relates to a fan, and in particular to a fan rotatable without a motor.

A conventional fan is actuated by a single motor for expelling airflow to dissipate heat from a heat source.

For example, if the different heat sources, e.g. a CPU, a power supply module, an image driver and a case of a computer, are respectively equipped with a conventional fan to dissipate heat, the number of the motors is increased correspondingly and thus noise and cost are increased.

SUMMARY

The invention provides a fan actuated by a main airflow from a feeding port so that the fan can be rotated without a motor, thus decreasing cost and power consumption.

An axial fan system includes a first airflow generator providing a main airflow, a duct having a first feeding port to guide the main airflow, and a first fan. The first fan includes a base, a rotor connected to the base by a shaft, and a plurality of blades connected to the rotor. Each blade includes a passive part corresponding to the first feeding port and an active part. The main airflow drives the passive part rotating about the shaft to synchronously rotate the active part.

The passive part is near the rotor and the active part is far from the rotor. The main airflow from the first feeding port is divided into a first airflow and a second airflow by the passive part, so that a pressure difference formed between the first and second airflows drives the passive part to rotate about the shaft.

The passive part can have a wing section. The first fan further includes an inlet and an outlet, and the pressure at the outlet is smaller than that at the inlet when the active part rotates about the shaft, to impel the main airflow.

The fan system further includes a bearing connecting the shaft to the base. The bearing can be selected from the group of a sleeve bearing, a ball bearing and a magnetic bearing.

The first fan further includes a housing and a rib connected to the housing and the base.

The duct further includes a second feeding port, and the duct distributes the main airflow to the first feeding port and the second feeding port.

The fan system further includes a second airflow generator, and the duct distributes the main airflow to the first feeding port and the second feeding port.

The fan system further includes a second airflow generator, and the duct distributes the main airflow to the first feeding port.

The first airflow generator can be selected from the group of an axial fan motor and a centrifugal fan motor.

The second airflow generator can be selected from the group of an axial fan motor and a centrifugal fan motor.

DESCRIPTION OF THE DRAWINGS

The invention can be more fully understood by reading the subsequent detailed description and examples with references made to the accompanying drawings, wherein.

DETAILED DESCRIPTION

Figure 1:
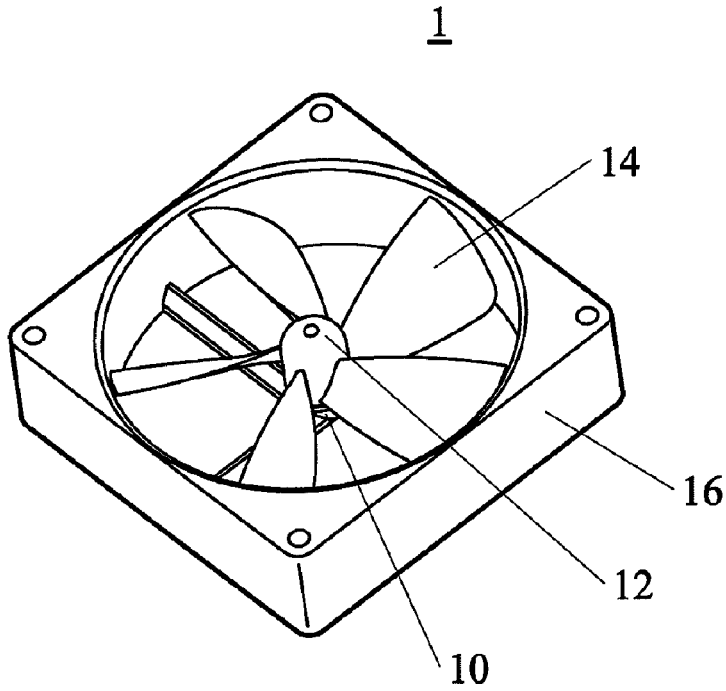
FIG. 1 is a schematic perspective view of a fan of a fan system of the invention.
Figure 2:
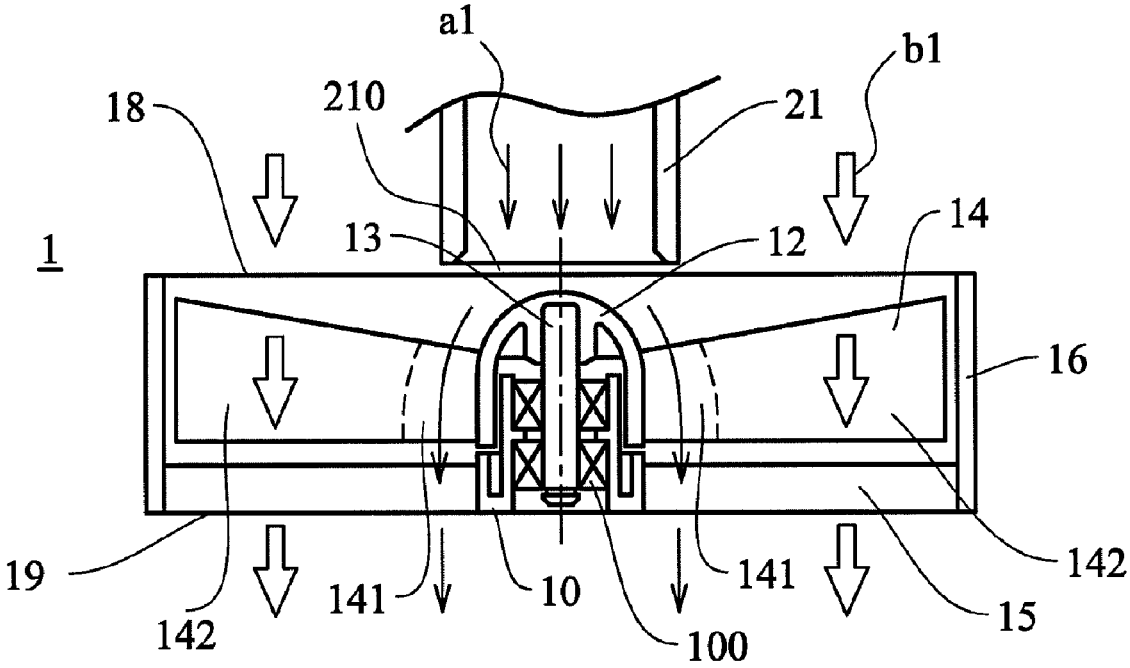
FIG. 2 is a schematic sectional view of a fan of a fan system of the invention.
Figure 4:
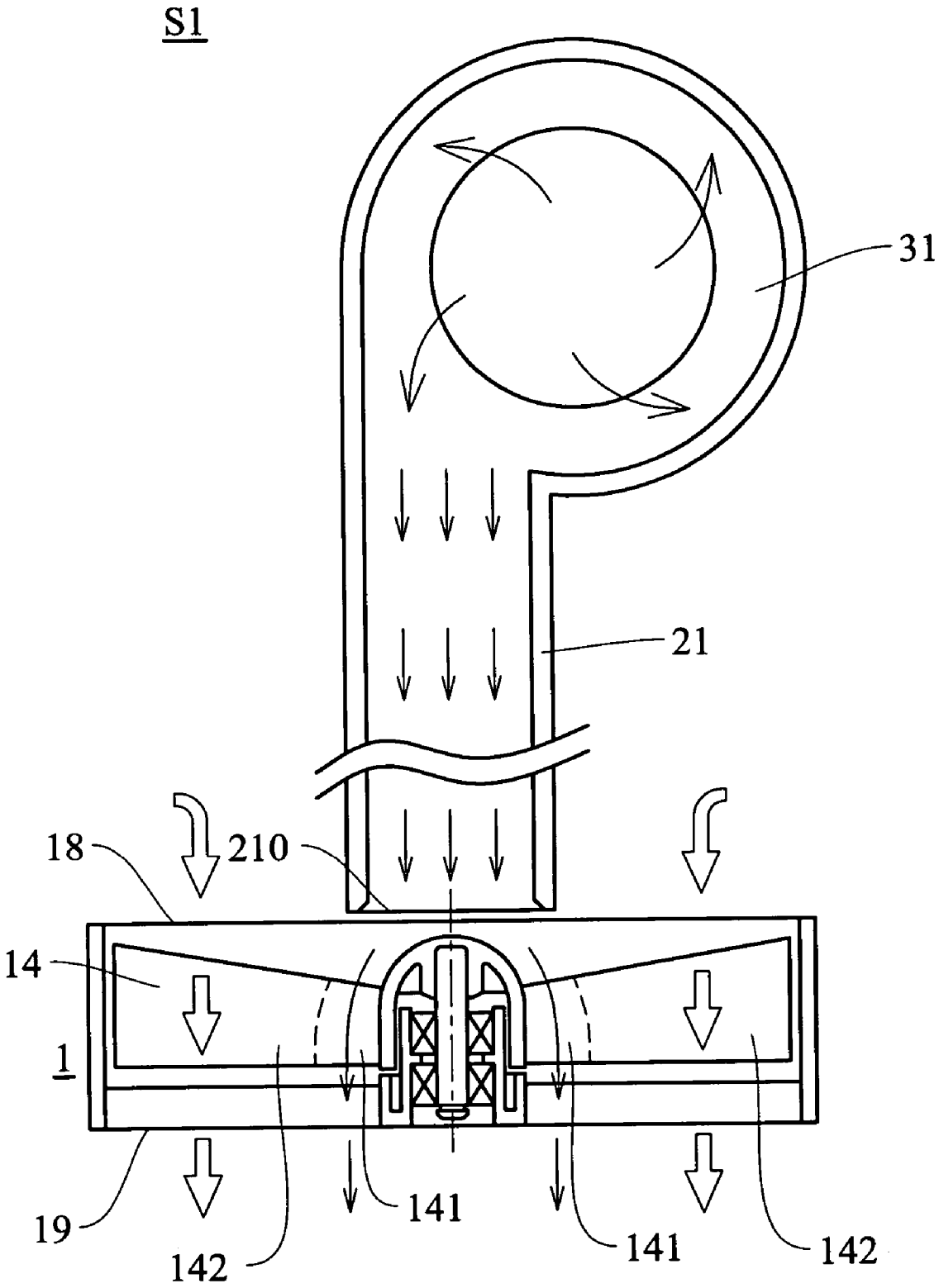
FIG. 4 is a schematic sectional view of a fan system of the first embodiment of the invention.

FIG. 4 shows a sectional view of a fan system S1 of the first embodiment of the invention, and FIGS. 1 and 2 are perspective and sectional views of the fan 1 of the fan system S1. The first fan 1 is disposed on an electronic device (not shown).

In FIG. 4, the fan system S1 of the invention includes a first airflow generator 31 providing a main airflow, a duct 21 having a first feeding port 210 and a first fan 1. In this embodiment, the first airflow generator 31 can be an axial fan motor or a centrifugal fan motor, or other device capable of generating airflow. The duct 21 connected to the first airflow generator 31 guides a main airflow from the first feeding port 210 of the first airflow generator 31.

In FIGS. 1 and 2, the first fan 1 includes a base 10, a rotor 12, a shaft 13 disposed on the base 10, a plurality of blades 14 radially connected to the rotor 12, a rib 15, a housing 16, a bearing 100, an inlet 18 and an outlet 19. The base 10 is connected to the housing 16 by at least one rib 15. The housing 16 is used to define the field of airflow. The rotor 12 is connected to the base 10 by the shaft 13, so that the rotor 12 connected with the blades 14 rotates about the shaft 13 with respect to the base 10 to dissipate heat from the electronic device.

A main airflow provided from the first airflow generator 31 passes through the duct 21 and outputs from the first feeding port 210, to blow on the blades 14 generating power. Each blade 14 includes a passive part 141 corresponding to a first feeding port 210 of the first airflow generator 31 and an active part 142.

Figure 3A:
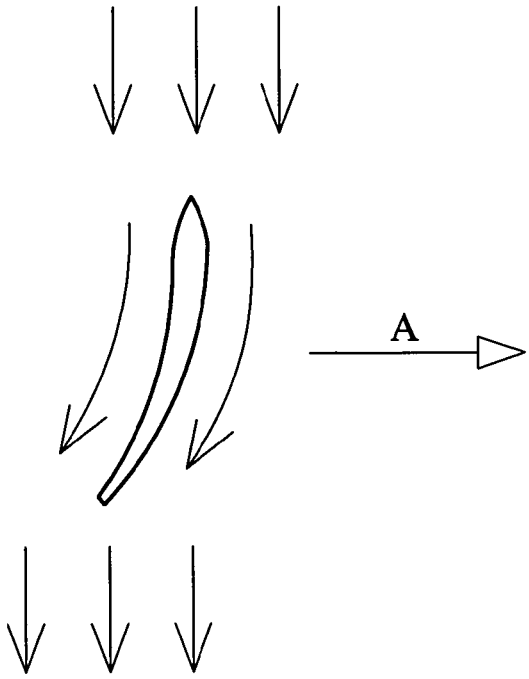
FIG. 3A is a schematic sectional view of a passive part of the fan of a fan system of the invention.

FIG. 3A is a sectional view of the passive part 141 along an arc direction thereof. When the main airflow passes through the passive part 141 along the direction of arrows al shown in FIG. 2, the main airflow is divided into a first airflow and a second airflow due to different paths at both sides of the passive part 141. The passive part 141 is preferably formed with a wing section, to form a pressure difference between the first and second airflows. It is to be understood that the pressure difference between the first and second airflows drives the passive part 141 to move along the direction of arrows "A" shown in FIG. 2, according to Bernoulli's law, and thus the blades 14 are rotated about the shaft 13, i.e., the active parts 142 are synchronously rotated about the shaft 13.

Figure 3B:
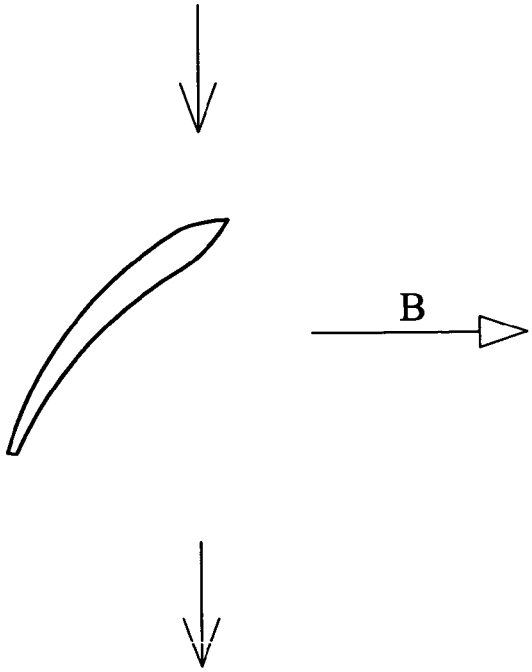
FIG. 3B is a schematic sectional view of an active part of the fan of a fan system of the invention.

FIG. 3B is a sectional view of the active parts 142 along an arc direction thereof. An arrow "B" shows the rotation direction of the active parts 142. Due to the active parts 142 with a section similar to a blade of a conventional fan, the pressure at the inlet 18 is lower than the pressure at the outlet 19 when the active parts 142 are rotated. Thus, external air can be drawn into the first fan 1 via the inlet 18 and expelled via the outlet 19 along the path of arrows b1, blowing on the electronic device to dissipate heat therefrom. Preferably, the passive parts 141 are placed near the rotor 12 and the active parts 142 are placed far from the rotor 12, but the arrangement is not limited to the disclosed embodiment. For example, the passive parts 141 can be placed far from the rotor 12, or the passive part 141 can be substantially placed at the middle of the blade 14.

With the duct 21, the first airflow generator 31 can be placed far from the first fan 1 disposed on the desired electronic device, i.e., the first airflow generator 31 and the first fan 1 are individually separated, to obtain better noise control quality.

As the main airflow from the first feeding port 210 impacts the passive parts 141, the rotor 12 and the blades 14 rotate about the shaft 13, generating the pressure difference by the active parts 142 of the blades 14 to impel the airflow. According to the law of conservation of energy, it is understood that the product of the volume of airflow in per unit time Q and the pressure P of the inlet 18 is equal to that of the outlet 19. Thus, the first feeding port 210 can provide a high-pressure airflow to blow on the passive parts 141 of the blades 14 rotating about the shaft 13. With the conversion of the first fan 1, the exterior airflow can be drawn into the first fan 1 to increase flow rate of the airflow of the outlet 19 and to decrease the pressure at the outlet 19, thus the low-pressure airflow from the outlet 19 blows on, but does not damage, the delicate heat source while dissipating heat therefrom.

Figure 5:
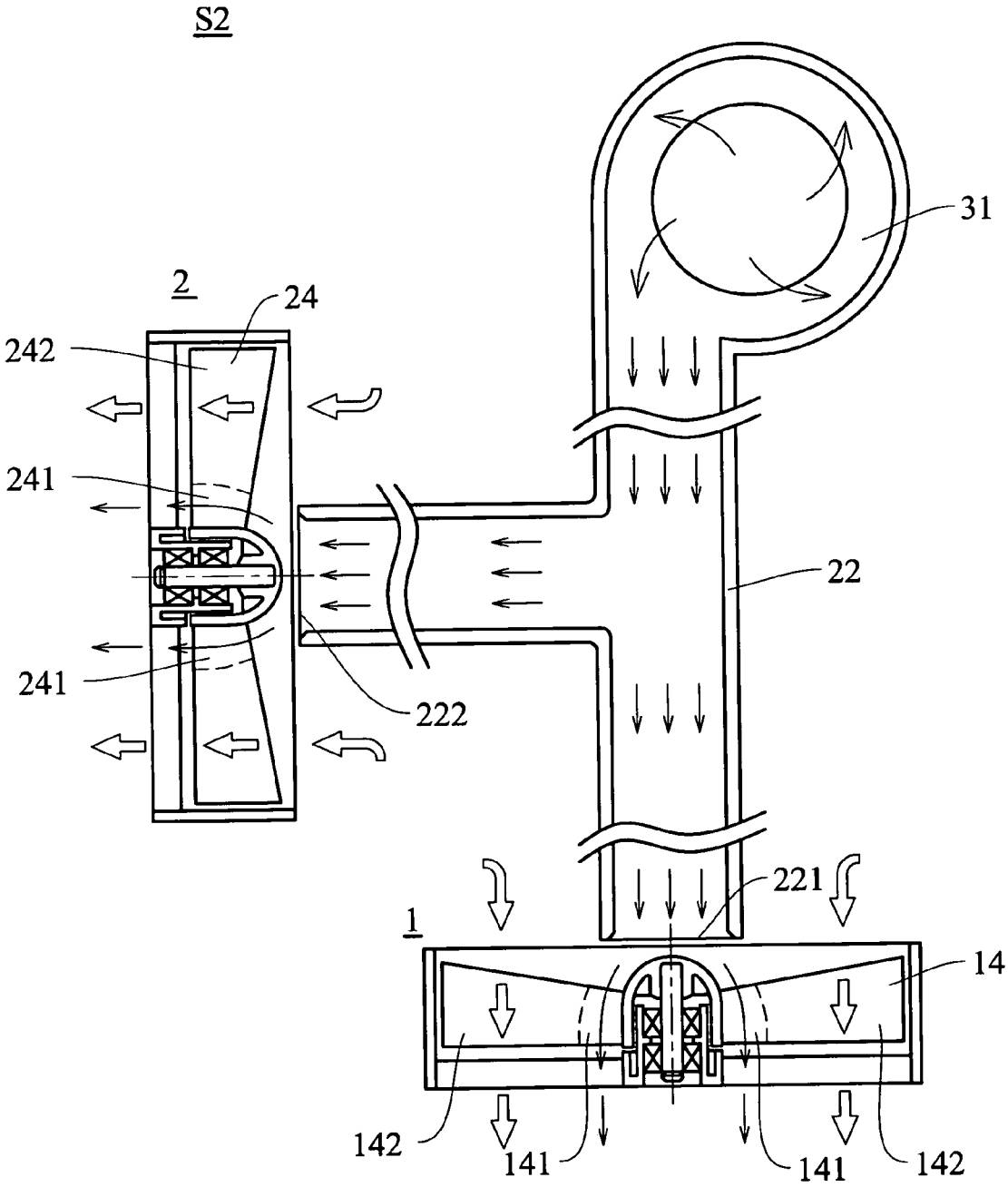
FIG. 5 is a schematic sectional view of a fan system of the second embodiment of the invention.

In FIG. 5, a fan system S2 of the second embodiment, derived from the configuration of the first embodiment, includes a first fan 1 having a plurality of blades 14, a second fan 2 having a plurality of blades 24, a first airflow generator 31 providing a main airflow, and a duct 22 having a first feeding port 211 and a second feeding port 212. In this embodiment, the first fan 1 is the same as the second fan 2, and the first airflow generator 31 can be an axial fan motor or a centrifugal fan motor, or other device capable of generating airflow.

Each blade 14 includes a passive part 141 corresponding to the first feeding port 221 of the duct 22 and an active part 142, and each blade 24 includes a passive part 241 corresponding to the second feeding port 222 of the duct 22 and an active part 242.

The main airflow conducted by the duct 22 is divided into to two separated airflows flowing to the first and second fans 1 and 2, to dissipate heat from the electronic devices not shown.

For example, heat sources, e.g. a CPU, a power supply module, an image driver and a case, of a host of a computer generate heat when operating. Each heat source can be equipped with the first or second fans 1 or 2 of the invention, driven by the same airflow from the first airflow generator 31 to efficiently dissipate heat and decrease the number of motors of the related art. Note that the first airflow generator 31 can be placed far from the host to reduce noise and vibration.

Figure 6:
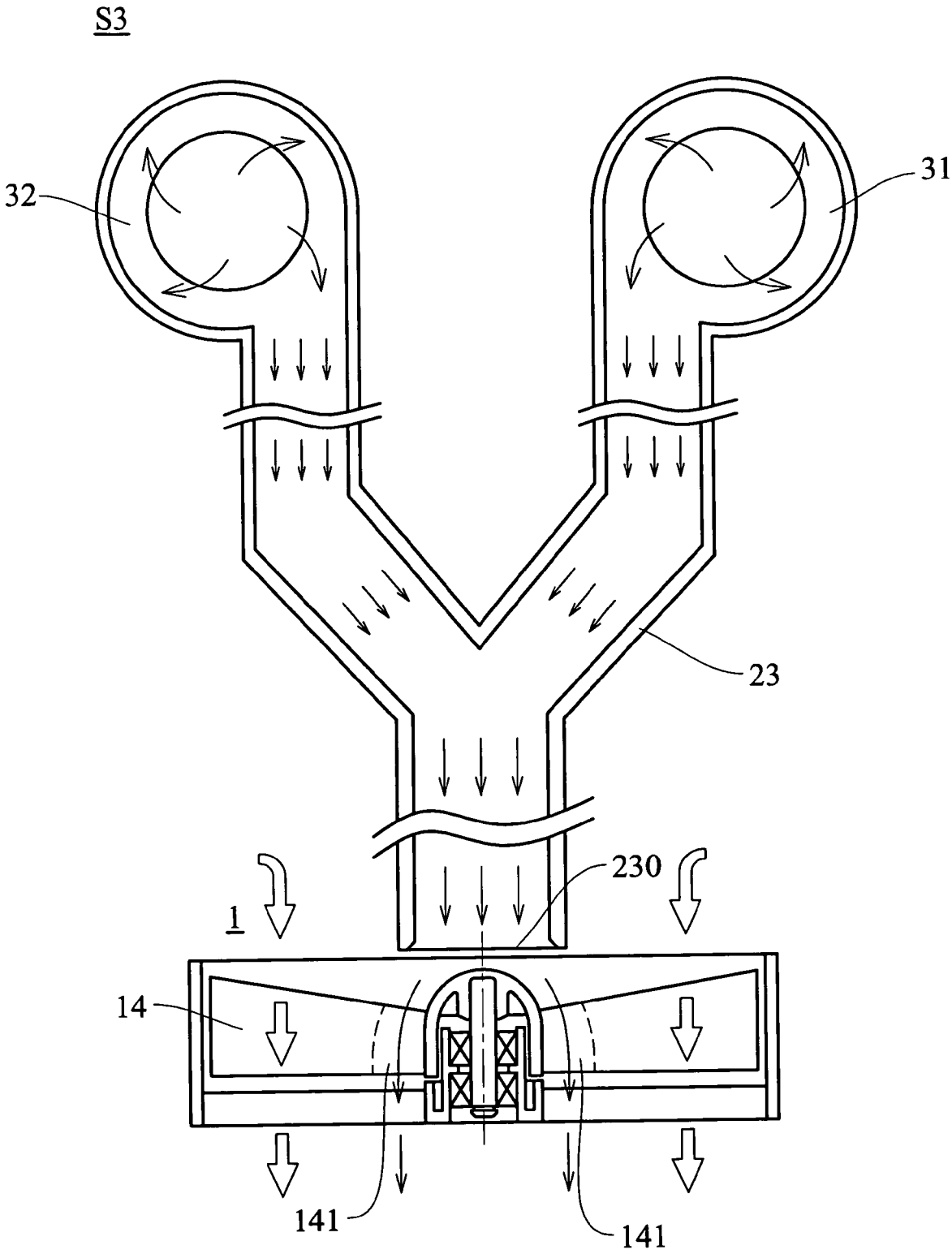
FIG. 6 is a schematic sectional view of a fan system of the third embodiment of the invention.

In FIG. 6, a fan system S3 of the third embodiment includes a first fan 1 having a plurality of blades 14, a first and second airflow generators 31 and 32 providing a main airflow, and a duct 23 having a first feeding port 230. In this embodiment, the first or second airflow generators 31 or 32 can be an axial fan motor or a centrifugal fan motor, or other device capable of generating airflow. Each blade 14 includes a passive part 141 corresponding to the first feeding port 230 of the duct 23 and an active part 142.

In this embodiment, the fan system S3 uses two airflow generators 31 and 32 to generate the main airflow to the first fan 1. Therefore, based on the desired functions and minimum requirements, e.g., rate of airflow and pressure, the size of the airflow generators 31 and 32 can be minimized, to reduce cost and noise.

While the invention has been described with respect to preferred embodiment, it is to be understood that the invention is not limited thereto, but, on the contrary, is intended to accommodate various modifications and equivalent arrangements included within the spirit and scope of the appended claims.

What is claimed is:

1. A fan system, comprising:

a first airflow generator;

a duct coupled to the first airflow generator to guide a main airflow from the first airflow generator, comprising a first feeding port; and a first fan comprising:

a base;

a rotor mounted on the base; and at least one blade disposed around the rotor, and each said at least one blade comprising a passive part corresponding to the first feeding port of the duct and an active part extending directly from the passive part so that the main airflow from the first feeding port of the duct drives the passive part of the at least one blade to rotate so as to synchronously rotate the active part of the at least one blade.

2. The fan system as claimed in claim 1, wherein the passive part of the least one blade is near the rotor and the active part of the least one blade is far from the rotor.

3. The fan system as claimed in claim 1, wherein the main airflow from the first feeding port of the duct is divided into a first airflow and a second airflow by the passive part of the least one blade so that a pressure difference formed between the first and second airflows drives the passive part of the least one blade to rotate.

4. The fan system as claimed in claim 3, wherein the passive part and the active port of the least one blade comprise a wing section, respectively.

5. The fan system as claimed in claim 1, wherein the first fan further comprises an inlet and an outlet, and the pressure at the outlet is smaller than that at the inlet when the active part of the least one blade rotates.

6. The fan system as claimed in claim 1 further comprising a bearing for coupling a shaft of the rotor to the base of the first fan.

7. The fan system as claimed in claim 6, wherein the bearing is a sleeve bearing, a ball bearing or a magnetic bearing.

8. The fan system as claimed in claim 1, wherein the first fan further comprises a housing connected to the base by a rib.

9. The fan system as claimed in claim 1, wherein the duct further comprises a second feeding port, and the duct distributes the main airflow from the first airflow generator to the first feeding port and the second feeding port thereof.

10. The fan system as claimed in claim 9 further comprising a second fan disposed near the second feeding port of the duct.

11. The fan system as claimed in claim 10, wherein the first and second fans are axial fans without a motor, respectively.

12. The fan system as claimed in claim 9 further comprising a second airflow generator, and the duct guides the main airflow from the second airflow generator to the first feeding port and the second feeding port thereof.

13. The fan system as claimed in claim 12, wherein the second airflow generator is an axial fan motor or a centrifugal fan motor.

14. The fan system as claimed in claim 1 further comprising a second airflow generator, and the duct guides the main airflow to the first feeding port of the duct.

15. The fan system as claimed in claim 14, wherein the second airflow generator is an axial fan motor or a centrifugal fan motor.

16. The fan system as claimed in claim 1, wherein the first airflow generator is an axial fan or a centrifugal fan.

17. A fan system, comprising:

a first airflow generator;

a duct coupled to the first airflow generator to guide a main airflow from the first airflow generator, comprising a first feeding port; and a first fan comprising:

a base;

a rotor mounted on the base; and a blade disposed around the rotor, comprising a passive part corresponding to the first feeding port of the duct and an active part extending directly from the passive part so that the main airflow from the first feeding port of the duct drives the passive part of the blade to rotate so as to synchronously rotate the active part of the at least one blade.

* * * * *